US010262477B1

(12) United States Patent
Nguyen

(10) Patent No.: US 10,262,477 B1
(45) Date of Patent: Apr. 16, 2019

(54) DETERMINATION OF ROAD CONDITIONS USING SENSORS ASSOCIATED WITH A VEHICLE

(71) Applicant: Lytx, Inc., San Diego, CA (US)

(72) Inventor: Vincent Nguyen, San Diego, CA (US)

(73) Assignee: Lytx, Inc., San Diego, CA (US)

( * ) Notice: Subject to any disclaimer, the term of this patent is extended or adjusted under 35 U.S.C. 154(b) by 78 days.

(21) Appl. No.: 15/368,501

(22) Filed: Dec. 2, 2016

(51) Int. Cl.
*G07C 5/08* (2006.01)

(52) U.S. Cl.
CPC ..... *G07C 5/0841* (2013.01)

(58) Field of Classification Search
CPC combination set(s) only.
See application file for complete search history.

(56) References Cited

U.S. PATENT DOCUMENTS 9,846,174 B2 * 12/2017 Schwartz ..... G01P 13/02
2003/0191568 A1 * 10/2003 Breed ..... B60W 40/06 701/36
2007/0142987 A1 * 6/2007 Takamatsu ..... B60L 7/18 701/41
2008/0243334 A1 * 10/2008 Bujak ..... B60G 17/0165 701/37
2009/0120175 A1 * 5/2009 Assaf ..... B60W 40/072 73/114.12
2011/0087410 A1 * 4/2011 Cimatti ..... B60K 17/35 701/60
2013/0136306 A1 * 5/2013 Li ..... G02B 27/28 382/103
2013/0313033 A1 * 11/2013 Elliott ..... F16H 61/47 180/197
2014/0094989 A1 * 4/2014 Dadu ..... G08G 1/0962 701/1
2014/0195068 A1 * 7/2014 Boss ..... G06F 19/00 701/1
2014/0195112 A1 * 7/2014 Lu ..... B60G 17/015 701/37
2016/0133066 A1 * 5/2016 Lavie ..... G07C 5/08 701/31.4
2016/0280132 A1 * 9/2016 Palanimuthu ..... B60Q 9/008
2017/0113698 A1 * 4/2017 Zwegers ..... B60W 40/06
2017/0158117 A1 * 6/2017 Nespolo ..... B60Q 1/46
2017/0162054 A1 * 6/2017 Nespolo ..... G08G 1/166

* cited by examiner

*Primary Examiner* — Redhwan K Mawari
(74) *Attorney, Agent, or Firm* — Van Pelt, Yi & James LLP

(57) ABSTRACT

A system for determining road conditions includes an input interface and a processor. The input interface is configured to receive sensor data from one or more sensors. The processor is configured to determine vehicle maneuver data based at least in part on the sensor data; determine a road slipperiness value based at least in part on the vehicle maneuver data; and update an event detection threshold based at least in part on the road slipperiness value.

19 Claims, 9 Drawing Sheets

DETERMINATION OF ROAD CONDITIONS USING SENSORS ASSOCIATED WITH A VEHICLE

BACKGROUND OF THE INVENTION

Modern vehicles (e.g., airplanes, boats, trains, cars, trucks, etc.) can include a vehicle event recorder in order to better understand the timeline of an anomalous event (e.g., an accident). A vehicle event recorder typically includes a set of sensors, e.g., video recorders, audio recorders, accelerometers, gyroscopes, vehicle state sensors, GPS (global positioning system), etc., that report data, which is used to determine the occurrence of an anomalous event. Sensor data can then be transmitted to an external reviewing system. Anomalous event types include accident anomalous events, maneuver anomalous events, location anomalous events, proximity anomalous events, vehicle malfunction anomalous events, driver behavior anomalous events, or any other anomalous event types. Thresholds for detection of anomalous events typically depend on external conditions (e.g., to identify a baseline danger level). However, information describing the external conditions can be difficult to obtain (for example, expensive, not continuously accessible, not accessible in all locations, etc.), creating a problem in accurately determining anomalous events.

BRIEF DESCRIPTION OF THE DRAWINGS

Various embodiments of the invention are disclosed in the following detailed description and the accompanying drawings.

DETAILED DESCRIPTION

Figure 1:
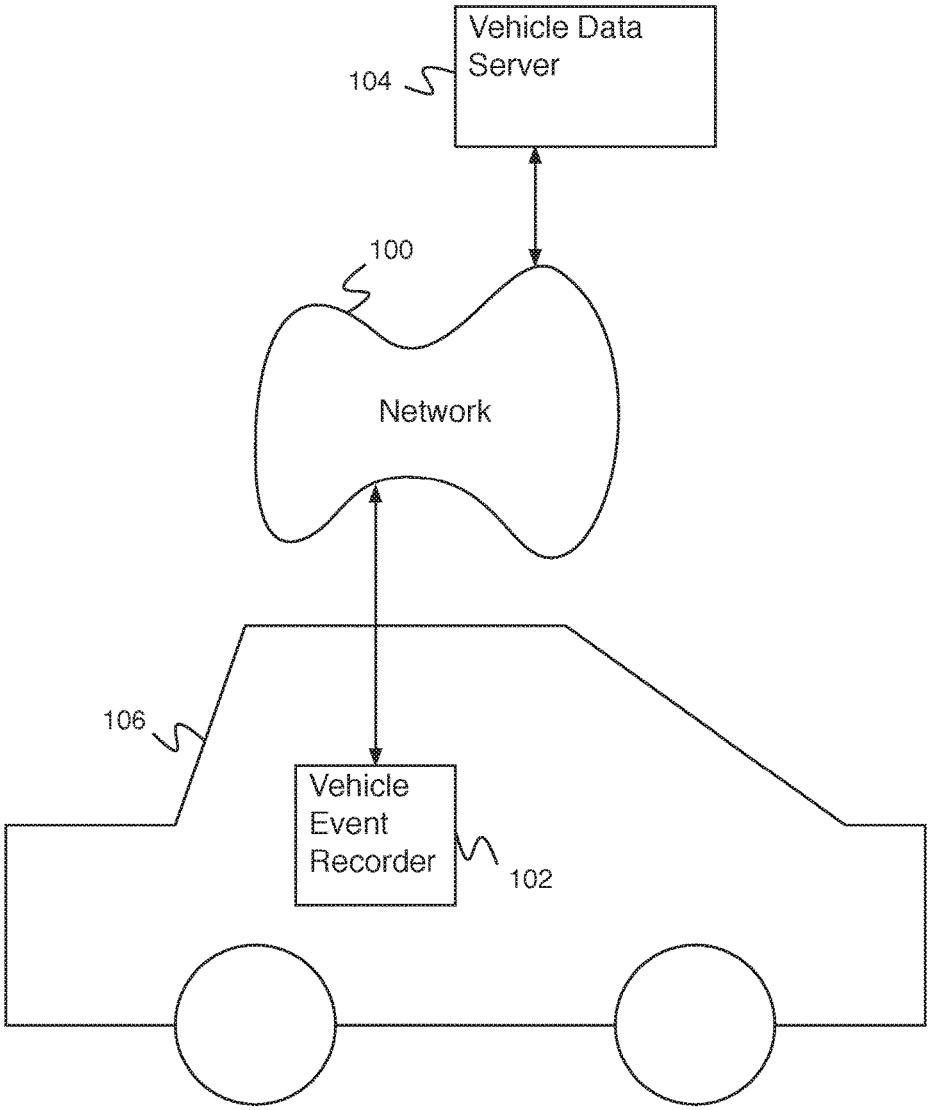
FIG. 1 is a block diagram illustrating an embodiment of a system including system for determining road conditions as part of a vehicle event recorder.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

A system for determining road conditions is disclosed. The system includes an interface and a processor. The interface is configured to receive sensor data from one or more sensors. The processor is configured to determine vehicle maneuver data based at least in part on the sensor data, determine a road slipperiness value based at least in part on the vehicle maneuver data, and update an event detection threshold based at least in part on the road slipperiness value.

In some embodiments, the system for determining road conditions determines an estimate of local road conditions based on an analysis of sensor data. For example, the local road condition(s) comprise one or more of the following: dry, slippery, icy, wet, dirt road, gravel road, paved road, or any other appropriate road condition. The estimate of local road conditions is determined by comparing performance of the vehicle as measured by the sensors with historical data, typical data, and/or models to indicate an estimate of the road conditions. For example, in measuring a vehicle maneuver (e.g., a stop at a stop sign), it is determined that the accelerometer, wheel speed, automatic brake signals, speedometer, odometer signals, or any other appropriate set or subset of sensor data match the profile of a road with a certain condition (e.g., a dry road, a wet road, a dirt road, a road under construction, a road with oil on it, a gravel road, a paved road, a cobblestone road, etc.). This certain condition is then, as an estimate of the road conditions, used to indicate a change in the event threshold(s). The event threshold(s) are used to indicate anomalous events or driving occurrences—for example, sensor data is monitored and when the signals exceed or match a set of thresholds (e.g., side accelerometer values exceed a threshold and brakes have been engaged for more than a time), then an event is indicated.

In some embodiments, a system for determining road conditions comprises a vehicle event recorder. The vehicle event recorder comprises a plurality of internal sensors and communications components. In various embodiments, the vehicle event recorder includes a video sensor, an audio sensor, an accelerometer, or any other appropriate sensor. In various embodiments, the vehicle event recorder includes a cellular communication circuit, a Wifi™ circuit, a Bluetooth™, a vehicle bus interface, or any other wired or wireless communication circuit. In various embodiments, the vehicle event recorder includes an interface to vehicle sensors, where vehicle sensors can provide data to the vehicle event recorder including one or more of the following types of data: accelerometer data, braking data, anti-lock braking system data, traction control data, drive wheel speed differential data (e.g., drive wheel speed differential is the difference between the angular speeds of the wheels that are being driven by the engine—for example, if it is a front wheel drive car, then the difference between the left and right front wheels; if it is a rear wheel drive car, then the difference between the left and right rear wheels; and if four wheel drive, then the difference between the left and right front wheels as a default definition), or any other appropriate data.

In some embodiments, the system for determining road conditions assembles data from sensors and associates the data with a maneuver (e.g., an accelerating maneuver, a braking maneuver, a cornering maneuver). The system then analyzes the vehicle maneuver data. In some embodiments, the analysis of the vehicle maneuver data includes an analysis of historic vehicle maneuver data in addition to the current vehicle maneuver data. In some embodiments, the system determines one or more instances of historic vehicle maneuver data (e.g., of a set of instances of historic vehicle maneuver data) as being relevant to the analysis. In various embodiments, the system determines one, two, three, or more instances of historic vehicle maneuver data that most closely matches the current sensor data.

In some embodiments, the instances of historic vehicle maneuver data have a corresponding road slipperiness value associated with them (e.g., a known road slipperiness during the recording of the historic vehicle maneuver data). Determining an overall road slipperiness value can be achieved by determining the road slipperiness value associated with the historic vehicle maneuver data that most closely matches the sensor data, or a combination of road slipperiness values associated with the two or more instances of historic vehicle maneuver data combined to match the sensor data.

In some embodiments, the determination of road slipperiness from vehicle maneuver data includes using a parameterized model of sensor data associated with a maneuver (e.g., a model including a set of parameters). By selecting a parameterized model from a set of parameterized models and by determining a set of parameter values for the parameterized model that match the vehicle maneuver data, the model selection and the parameter selection enables the determination of road slipperiness. For example, an overall road slipperiness value is determined from the parameter values and a road slipperiness computation associated with the parametrized model.

FIG. 1 is a block diagram illustrating an embodiment of a system including system for determining road conditions as part of a vehicle event recorder. In the example shown, vehicle event recorder 102 comprises a vehicle event recorder mounted in a vehicle (e.g., a car or truck). Vehicle event recorder 102 includes or is in communication with a set of sensors—for example, video recorders, audio recorders, accelerometers, gyroscopes, vehicle state sensors, proximity sensors, a global positioning system (e.g., GPS), outdoor temperature sensors, moisture sensors, laser line tracker sensors, or any other appropriate sensors. In various embodiments, vehicle state sensors comprise a speedometer, an accelerator pedal sensor, a brake pedal sensor, an engine revolutions per minute (e.g., RPM) sensor, an engine temperature sensor, a headlight sensor, an airbag deployment sensor, driver and passenger seat weight sensors, an anti-locking brake sensor, traction control system sensors, drive wheel speed sensors, an engine exhaust sensor, a gear position sensor, a cabin equipment operation sensor, or any other appropriate vehicle state sensors. Vehicle event recorder 102 comprises a system for processing sensor data and detecting events. In various embodiments, vehicle event recorder 102 is mounted on vehicle 106 in one of the following locations: the chassis, the front grill, the dashboard, the rear-view mirror, or any other appropriate location. In some embodiments, vehicle event recorder 102 comprises multiple units mounted in different locations in vehicle 106. Vehicle event recorder 102 comprises a communications system for communicating with network 100. In various embodiments, network 100 comprises a wireless network, a wired network, a cellular network, a Code Division Multiple Access (CDMA) network, a Global System for Mobile Communication (GSM) network, a Long-Term Evolution (LTE) network, a Universal Mobile Telecommunications System (UMTS) network, a Worldwide Interoperability for Microwave Access (WiMAX) network, a Dedicated Short-Range Communications (DSRC) network, a local area network, a wide area network, the Internet, or any other appropriate network. In some embodiments, network 100 comprises multiple networks, changing over time and location. In some embodiments, different networks comprising network 100 comprise different bandwidth cost (e.g., a wired network has a very low cost, a wireless Ethernet connection has a moderate cost, a cellular data network has a high cost, etc.). In some embodiments, network 100 has a different cost at different times (e.g., a higher cost during the day and a lower cost at night). Vehicle event recorder 102 communicates with vehicle data server 104 via network 100. Vehicle event recorder 102 is mounted to vehicle 106. In various embodiments, vehicle 106 comprises a car, a truck, a commercial vehicle, or any other appropriate vehicle. Vehicle data server 104 comprises a vehicle data server for collecting events detected by vehicle event recorder 102. In some embodiments, vehicle data server 104 comprises a system for collecting data from multiple vehicle event recorders. In some embodiments, vehicle data server 104 comprises a system for analyzing vehicle event recorder data. In some embodiments, vehicle data server 104 comprises a system for displaying vehicle event recorder data. In some embodiments, vehicle data server 104 is located at a home station (e.g., a shipping company office, a taxi dispatcher, a truck depot, etc.). In various embodiments, vehicle data server 104 is located at a colocation center (e.g., a center where equipment, space, and bandwidth are available for rental), at a cloud service provider, or any at other appropriate location. In some embodiments, events recorded by vehicle event recorder 102 are downloaded to vehicle data server 104 when vehicle 106 arrives at the home station. In some embodiments, vehicle data server 104 is located at a remote location. In some embodiments, events recorded by vehicle event recorder 102 are downloaded to vehicle data server 104 wirelessly. In some embodiments, a subset of events recorded by vehicle event recorder 102 is downloaded to vehicle data server 104 wirelessly. In some embodiments, vehicle event recorder 102 comprises a system for determining risky events.

Figure 2:
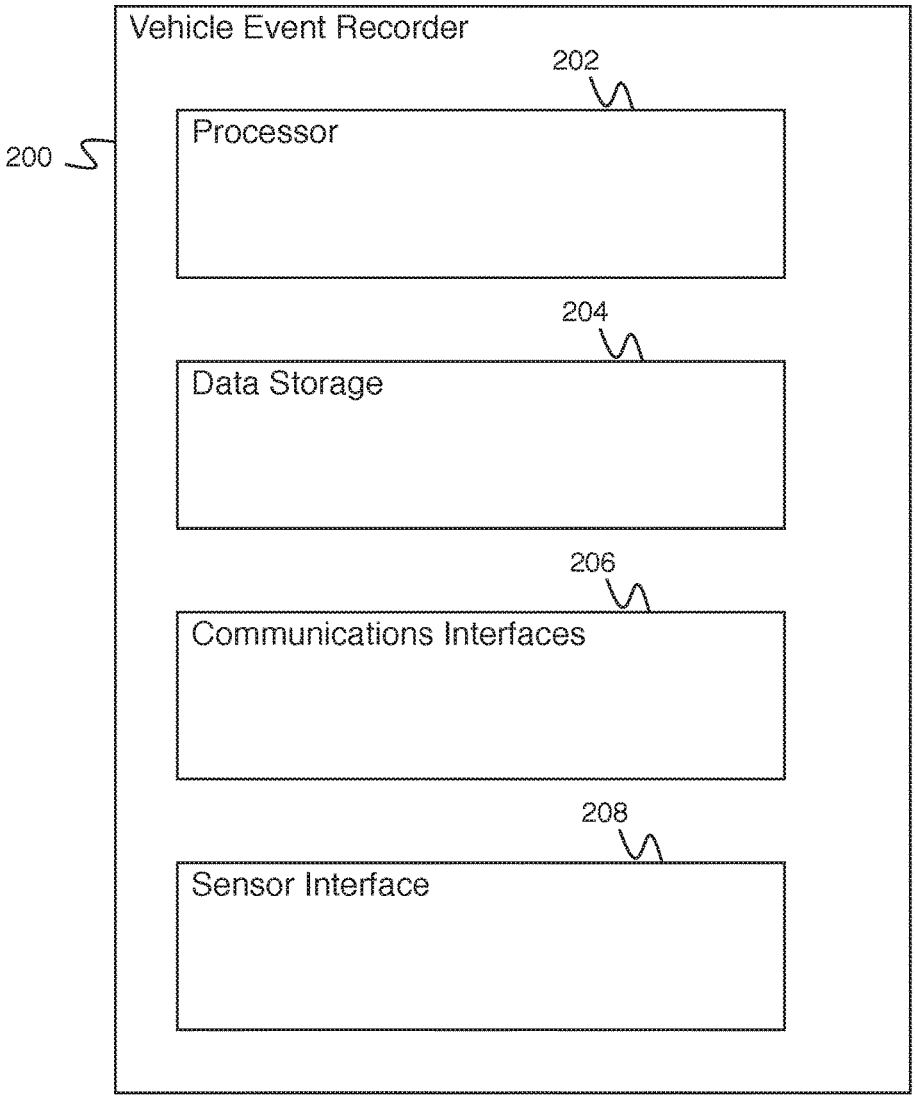
FIG. 2 is a block diagram illustrating an embodiment of a vehicle event recorder.

FIG. 2 is a block diagram illustrating an embodiment of a vehicle event recorder. In some embodiments, vehicle event recorder 200 of FIG. 2 comprises vehicle event recorder 102 of FIG. 1. In the example shown, vehicle event recorder 200 comprises processor 202. Processor 202 comprises a processor for controlling the operations of vehicle event recorder 200, for reading and writing information on data storage 204, for communicating via wireless communications interface 206, and for reading data via sensor interface 208. Data storage 204 comprises a data storage (e.g., a random access memory (RAM), a read only memory (ROM), a nonvolatile memory, a flash memory, a hard disk, or any other appropriate data storage). In various embodiments, data storage 204 comprises a data storage for storing instructions for processor 202, vehicle event recorder data, vehicle event data, sensor data, video data, driver data, or any other appropriate data. In various embodiments, communications interfaces 206 comprises one or more of a global system for mobile communications (GSM) interface, a code division multiple access (CDMA) interface, a long term evolution (LTE) interface, a WiFi™ interface, an Ethernet interface, a Universal Serial Bus (USB) interface, a Bluetooth™ interface, an Internet interface, or any other appropriate interface. Sensor interface 208 comprises an interface to one or more vehicle event recorder sensors. In various embodiments, vehicle event recorder sensors comprise an exterior video camera, an exterior still camera, an interior video camera, an interior still camera, a microphone, an accelerometer, a gyroscope, an outdoor temperature sensor, a moisture sensor, a laser line tracker sensor, vehicle state sensors, or any other appropriate sensors. In various embodiments, vehicle state sensors comprise a speedometer, an accelerator pedal sensor, a brake pedal sensor, an engine revolutions per minute (RPM) sensor, an engine temperature sensor, a headlight sensor, an airbag deployment sensor, driver and passenger seat weight sensors, an anti-locking brake sensor, an engine exhaust sensor, a gear position sensor, a turn signal sensor, a cabin equipment operation sensor, or any other appropriate vehicle state sensors. In some embodiments, sensor interface 208 comprises an on-board diagnostics (OBD) bus (e.g., society of automotive engineers (SAE) J1939, J1708/J1587, OBD-II, CAN BUS, etc.). In some embodiments, vehicle event recorder 200 communicates with vehicle state sensors via the OBD bus. Vehicle event recorder 200 communicates with a vehicle data server via communications interfaces 206. Vehicle event recorder 200 transmits vehicle state sensor data, accelerometer data, speed data, maneuver data, audio data, video data, event data, or any other appropriate data to the vehicle data server.

In some embodiments, vehicle event recorder 200 comprises a system for determining events from data. In some embodiments, vehicle event recorder 200 stores data in a time-delay buffer (e.g., a buffer holding the last 30 seconds of data, the last 5 minutes of data, a day's worth of data, a week's worth of data, etc.). In some embodiments, data is deleted from the time-delay buffer after the time-delay period (e.g., a buffer holding the last 30 seconds of data deletes data as soon as it is more than 30 seconds old). In some embodiments, in the event an event is determined from data in the time-delay buffer, data associated with the event is copied from the time-delay buffer into a long-term storage. In various embodiments, event information and associated data is stored, processed, uploaded immediately, uploaded at a later time, provided to an administrator, or handled in any other appropriate way. In some embodiments, data is continually stored (e.g., and not deleted after a time-delay period). In some embodiments, in the event an event is determined from continuously stored data, an event flag is stored associated with the continuously stored data. In some embodiments, data storage is modified based at least in part on an event flag (e.g., data is stored at higher resolution in the vicinity of an event flag). In some embodiments, event data is extracted from continuously stored data. In some embodiments, event data is uploaded (e.g., immediately, at a later time, etc.). In some embodiments, flag data (e.g., an event type, an event severity, etc.) is uploaded. In some embodiments, flag metadata (e.g., a list of flags, a flag identifier, etc.) is uploaded.

Figure 3:
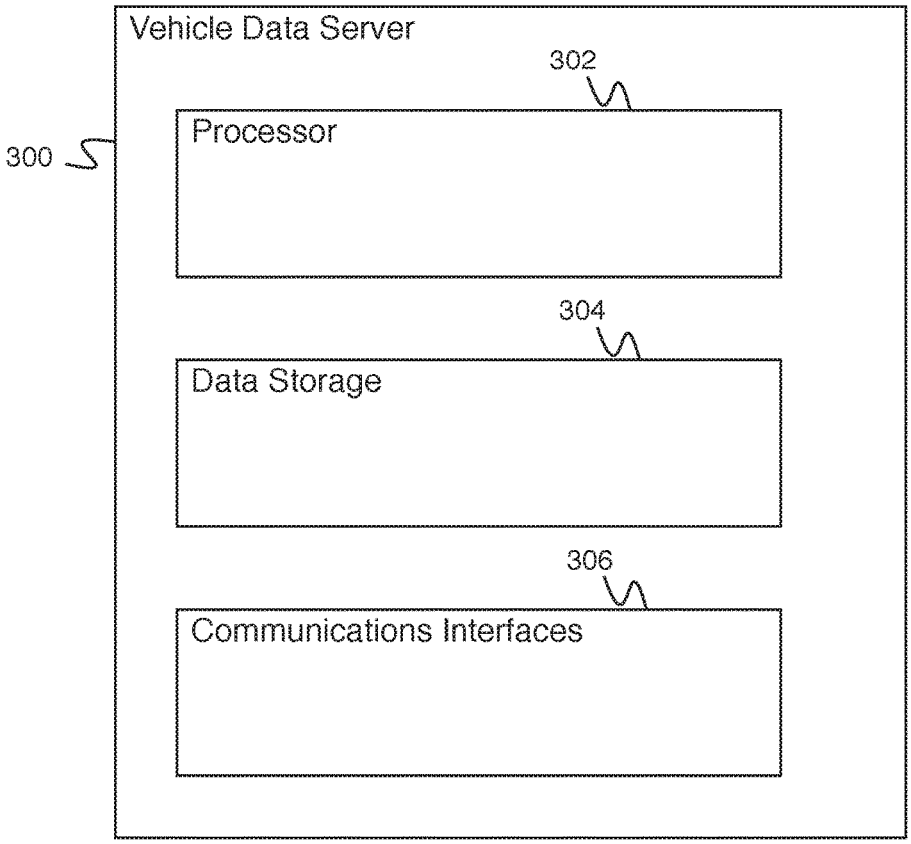
FIG. 3 is a block diagram illustrating an embodiment of a vehicle data server.

FIG. 3 is a block diagram illustrating an embodiment of a vehicle data server. In some embodiments, vehicle data server 300 comprises vehicle data server 104 of FIG. 1. In the example shown, vehicle data server 300 comprises processor 302. In various embodiments, processor 302 comprises a processor for determining a route, collecting speed data, determining a speed distribution, or for any other appropriate purpose. Data storage 304 comprises a data storage (e.g., a random access memory (RAM), a read only memory (ROM), a nonvolatile memory, a flash memory, a hard disk, or any other appropriate data storage). In various embodiments, data storage 304 comprises a data storage for storing instructions for processor 302, vehicle event recorder data, vehicle event data, sensor data, video data, map data, machine learning algorithm data, or any other appropriate data. In various embodiments, communications interfaces 306 comprises one or more of a GSM interface, a CDMA interface, a WiFi interface, an Ethernet interface, a USB interface, a Bluetooth interface, an Internet interface, a fiber optic interface, or any other appropriate interface. In various embodiments, vehicle data server 300 receives events, maneuvers, data, or any other appropriate information from one or more vehicle event recorders.

Figure 4:
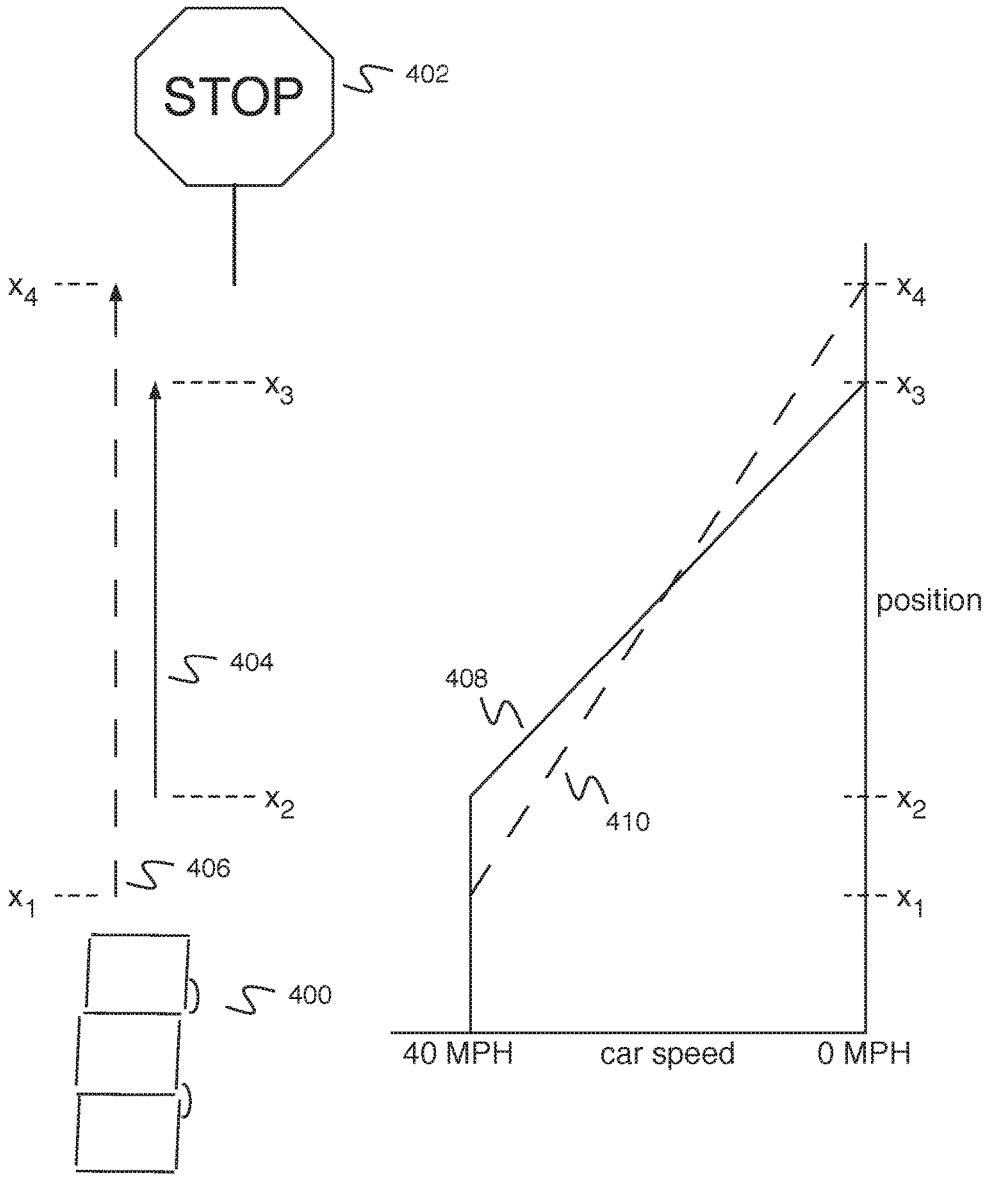
FIG. 4 is a diagram illustrating an embodiment of a stopping maneuver.

FIG. 4 is a diagram illustrating an embodiment of a stopping maneuver. In some embodiments, the stopping maneuver of FIG. 4 is used to determine road conditions by a system for determining road conditions. In the example shown, the driver of vehicle 400 sees stop sign 402 ahead and initiates a stopping maneuver. Line 404 indicates a stopping region, from $X_2$ to $X_3$, in dry weather. Line 406 indicates a stopping region, from $X_1$ to $X_4$, in wet weather. In the example shown, line 406 is longer than line 404 (e.g., the stopping distance in wet weather is longer than the stopping distance in dry weather). Line 408 indicates a plot of speed vs. position for the stopping region indicated by line 404 with speed plotted on the horizontal axis and distance plotted on the vertical axis. Line 410 indicates a plot of speed vs. position for the stopping region indicated by line 406 with speed plotted on the horizontal axis and distance plotted on the vertical axis. The vehicle speed falls faster for the vehicle in dry conditions than the vehicle speed falls in wet conditions. The dry conditions associated with line 404 and line 408 comprise a dry slipperiness value (e.g., 0 out of 10). The wet conditions associated with line 406 and line 410 comprise a wet slipperiness value (e.g., 7 out of 10). In various embodiments, the slipperiness value is associated with a stopping maneuver in a database by using measured value of slipperiness of the road surface, using a modeled slipperiness value as a function of humidity, using a manually input value of slipperiness associated with a road surface (e.g., pavement, gravel, dirt, wet, damp, oily, sandy, etc.), or any other appropriate manner of assigning an associated slipperiness value. Line 408 and line 410, or data for reconstructing the lines, are stored as historic vehicle maneuver data. A stopping maneuver in unknown conditions, for example newly acquired data, is compared to line 408 and line 410 to determine an associated slipperiness value (e.g., a stopping maneuver with vehicle stopping rate halfway between that of line 408 and line 410 is determined to have a slipperiness value of 3.5 out of 10 by interpolating the slope values of the lines and scaling the slipperiness values linearly). In some embodiments, additional historic vehicle maneuver data is used for comparison of stopping maneuvers in unknown conditions (e.g., data measured in extreme wet conditions, data measured in snowy conditions, data measured with leaves on the ground, etc. and the closest historical curve is used or the value is calculated by interpolation of the data associated with the historical data and the associated slipperiness). In some embodiments, line 408 and line 410 are used to create a parameterized model of a stopping maneuver during wet conditions. The parameterized model comprises one parameter for stopping rate. The parameterized model is compared to a measured stopping maneuver and the stopping rate parameter is chosen to match the measured data. A slipperiness value can then be determined from the chosen parameter value.

Figure 5:
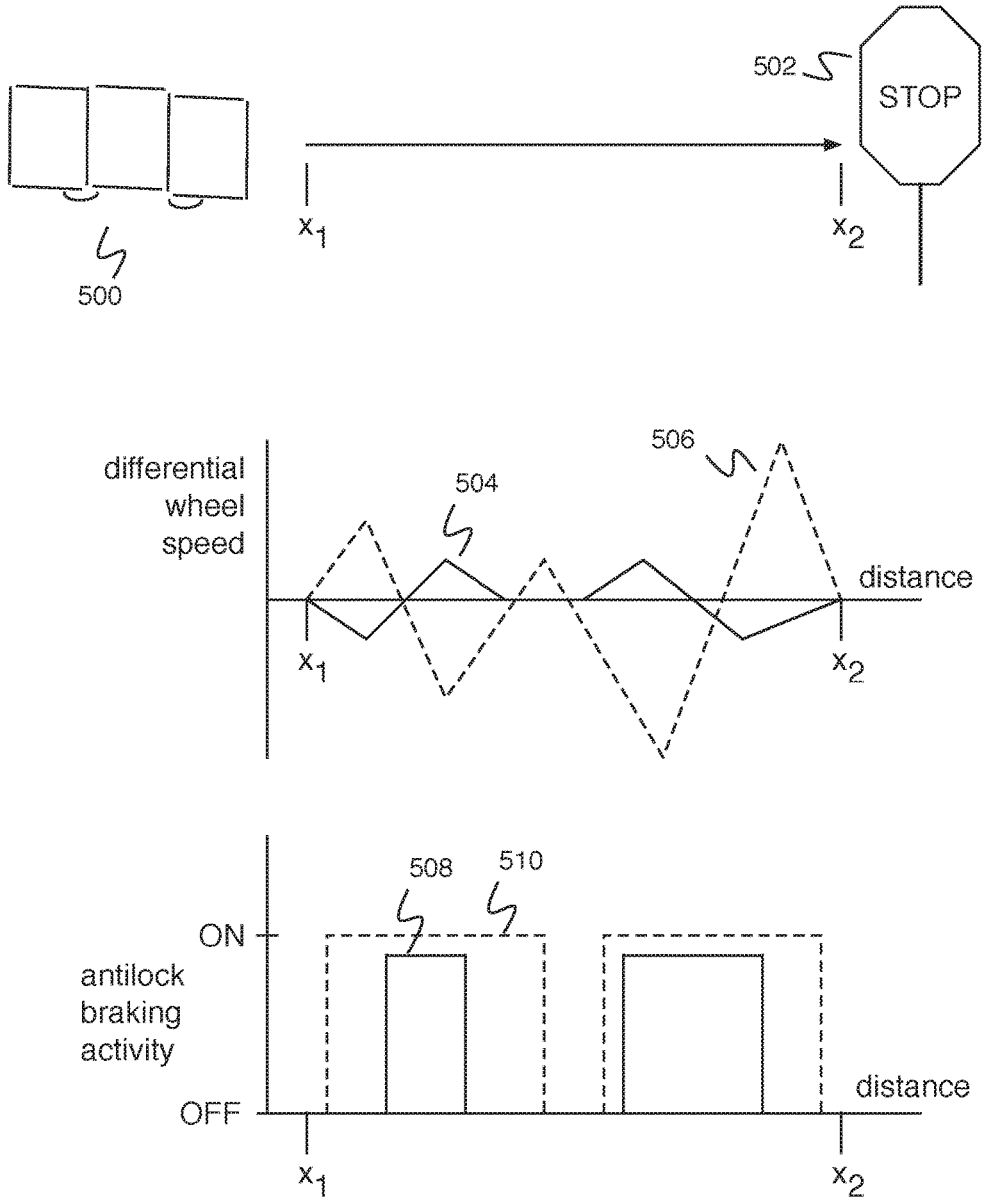
FIG. 5 is a diagram illustrating an embodiment of a stopping maneuver.

FIG. 5 is a diagram illustrating an embodiment of a stopping maneuver. In some embodiments, the stopping maneuver of FIG. 5 is used to determine road conditions by a system for determining road conditions. In the example shown, the driver of vehicle 500 sees stop sign 502 ahead and initiates a stopping maneuver between $X_1$ and $X_2$. Line 504 on a graph of differential wheel speed versus position indicates a vehicle drive wheel speed differential in dry weather. Line 506 on a graph of differential wheel speed versus position indicates a vehicle drive wheel speed differential in wet weather. Line 508 on a graph of antilock braking activity versus position indicates an anti-lock braking system activation signal in dry weather. Line 510 indicates an anti-lock braking system activation signal in wet weather. In the example shown, the magnitude of line 506 is greater than the magnitude of line 504 (e.g., there are greater wheel speed differentials in wet weather than in dry weather). Line 508 and line 510 indicate that a vehicle anti-lock braking system is active more of the time in wet weather than in dry weather. The dry conditions associated with line 504 and line 508 comprise a dry slipperiness value (e.g., 0 out of 10). The wet conditions associated with line 506 and line 510 comprise a wet slipperiness value (e.g., 7 out of 10). Line 508 and line 510, or data for reconstructing the lines, are stored as historic vehicle maneuver data. A stopping maneuver in unknown conditions is compared to line 508 and line 510 to determine an associated slipperiness value (e.g., a stopping maneuver with anti-lock braking system activity halfway between that of line 508 and line 510 is determined to have a slipperiness value of 3.5 out of 10 by interpolating the slope values of the lines and scaling the slipperiness values linearly). In some embodiments, additional historic vehicle maneuver data is used for comparison of stopping maneuvers in unknown conditions (e.g., data measured in extreme wet conditions, data measured in snowy conditions, data measured with leaves on the ground, etc. and the closest historical curve is used or the value is calculated by interpolation of the data associated with the historical data and the associated slipperiness). In some embodiments, line 508 and line 510 are used to create a parameterized model of a stopping maneuver during wet conditions. The parameterized model comprises a parameter for anti-lock braking system activity. The parameterized model is compared to a measured stopping maneuver and the anti-lock braking system activity parameter is chosen to match the measured data. A slipperiness value can then be determined from the chosen parameter value.

Figure 6:
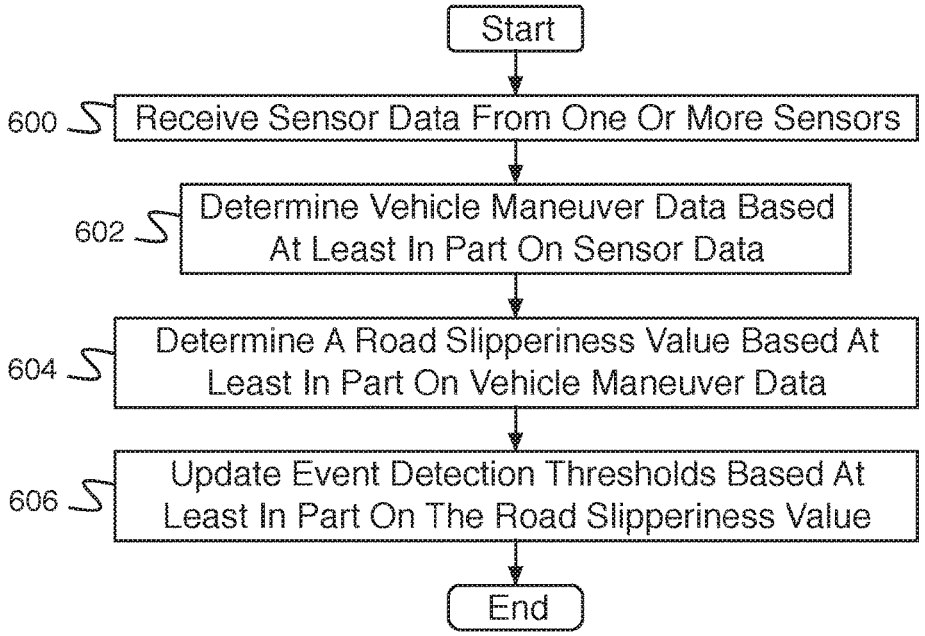
FIG. 6 is a flow diagram illustrating an embodiment of a process for determining road conditions using sensors associated with a vehicle.

FIG. 6 is a flow diagram illustrating an embodiment of a process for determining road conditions using sensors associated with a vehicle. In some embodiments, the process of FIG. 6 is executed by a vehicle event recorder (e.g., vehicle event recorder 102 of FIG. 1). In the example shown, in 600, sensor data is received from one or more sensors. In 602, vehicle maneuver data is determined based at least in part on sensor data. In some embodiments, vehicle maneuver data comprises historic vehicle maneuver data. In some embodiments, vehicle maneuver data comprises a parameterized model. In 604, a road slipperiness value is determined based at least in part on the vehicle maneuver data. In 606, event detection thresholds are updated based at least in part on the road slipperiness value. In some embodiments, a road slipperiness value is used to determine a road slipperiness category. In some embodiments, a road slipperiness category is determined by determining the road slipperiness range the road slipperiness value falls into (e.g., a road slipperiness value of 0 to 0.99 corresponds to a road slipperiness category of dry; a road slipperiness value of 1 to 1.99 corresponds to a road slipperiness category of damp; a road slipperiness value of 9 to 10 corresponds to extremely wet; etc.). In various embodiments, road slipperiness categories comprise dry, damp, lightly wet, medium wet, extremely wet, leafy, oily, or any other appropriate road slipperiness categories. In some embodiments, a road slipperiness value and/or a road slipperiness category are provided for storage (e.g., for storage by the vehicle event recorder, for storage by the vehicle data server, etc.).

In some embodiments, a set of road slipperiness values (e.g., a set of road slipperiness values taken at different times, a set of road slipperiness values taken at different locations, etc.) is stored and analyzed to determine a road slipperiness pattern. In some embodiments, a road slipperiness pattern comprises a weather pattern (e.g., a progression of road slipperiness across time or across an area). In some embodiments, a set of road slipperiness values is stored and analyzed to determine a road slipperiness anomaly (e.g., an isolated location of road slipperiness). In various embodiments, a road slipperiness anomaly is identified by a road slipperiness anomaly size, shape, magnitude, edge slope, duration, or any other appropriate road slipperiness anomaly characteristic. In various embodiments, a road slipperiness anomaly comprises a fluid spill on the road, a trash spill on the road, a pile of leaves on the road, an animal on the road, or any other appropriate road slipperiness anomaly. In some embodiments, a historical road slipperiness pattern associated with a vehicle is compared with historical weather information to determine vehicle wear (e.g., brakes wear, shocks wear, anti-lock braking system wear, etc.). In some embodiments, vehicle maintenance information is determined based at least in part on one or more historical road slipperiness values and on historical weather data.

Figure 7:
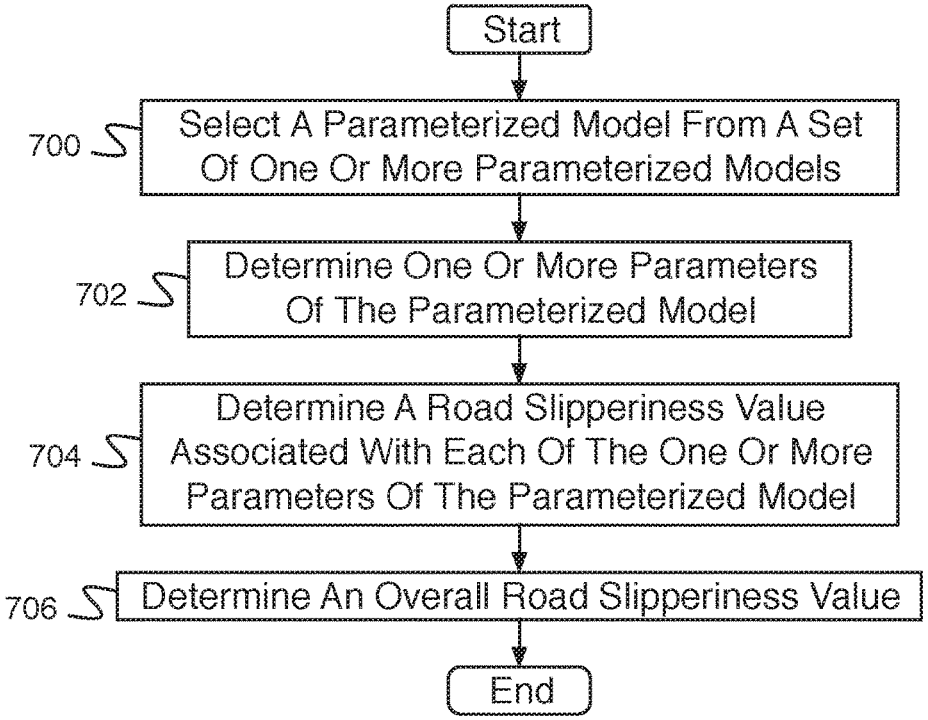
FIG. 7 is a flow diagram illustrating an embodiment of a process for determining vehicle maneuver data based at least in part on sensor data and determining a road slipperiness value based at least in part on vehicle maneuver data.

FIG. 7 is a flow diagram illustrating an embodiment of a process for determining vehicle maneuver data based at least in part on sensor data and determining a road slipperiness value based at least in part on vehicle maneuver data. In some embodiments, the process of FIG. 7 implements 602 of FIG. 6 and 604 of FIG. 6, in the event that vehicle maneuver data comprises a parameterized model. In the example shown, in 700, a parameterized model is selected from a set of one or more parameterized models. In 702, one or more parameters of the parameterized model are determined. In 704, a road slipperiness value associated with each of the one or more parameters of the parameterized model is determined. In 706, an overall road slipperiness value is determined.

Figure 8:
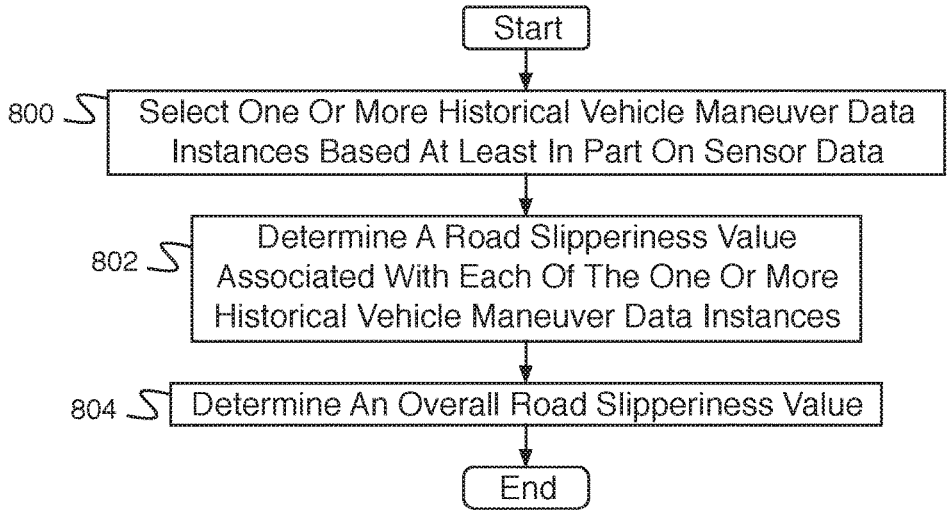
FIG. 8 is a flow diagram illustrating an embodiment of a process for determining vehicle maneuver data based at least in part on sensor data and determining a road slipperiness value based at least in part on vehicle maneuver data.

FIG. 8 is a flow diagram illustrating an embodiment of a process for determining vehicle maneuver data based at least in part on sensor data and determining a road slipperiness value based at least in part on vehicle maneuver data. In some embodiments, the process of FIG. 8 implements 602 of FIG. 6 and 604 of FIG. 6, in the event that vehicle maneuver data comprises historical vehicle maneuver data. In the example shown, in 800, one or more historical vehicle maneuver data instances are selected based at least in part on sensor data. In 802, a road slipperiness value associated with each of the one more historical vehicle maneuver data instances is determined. In 804, an overall road slipperiness value is determined. For example, the closest historical vehicle maneuver data instances is determined—for example, least square fitting value is minimized between an unknown new data curve and a historical data curve, and the associated slipperiness is associated with the unknown new data curve. In some embodiments, the two bracketing historical vehicle maneuver data are selected and the associated slipperiness are interpolated to determine a slipperiness value to associate with an unknown new data curve.

Figure 9:
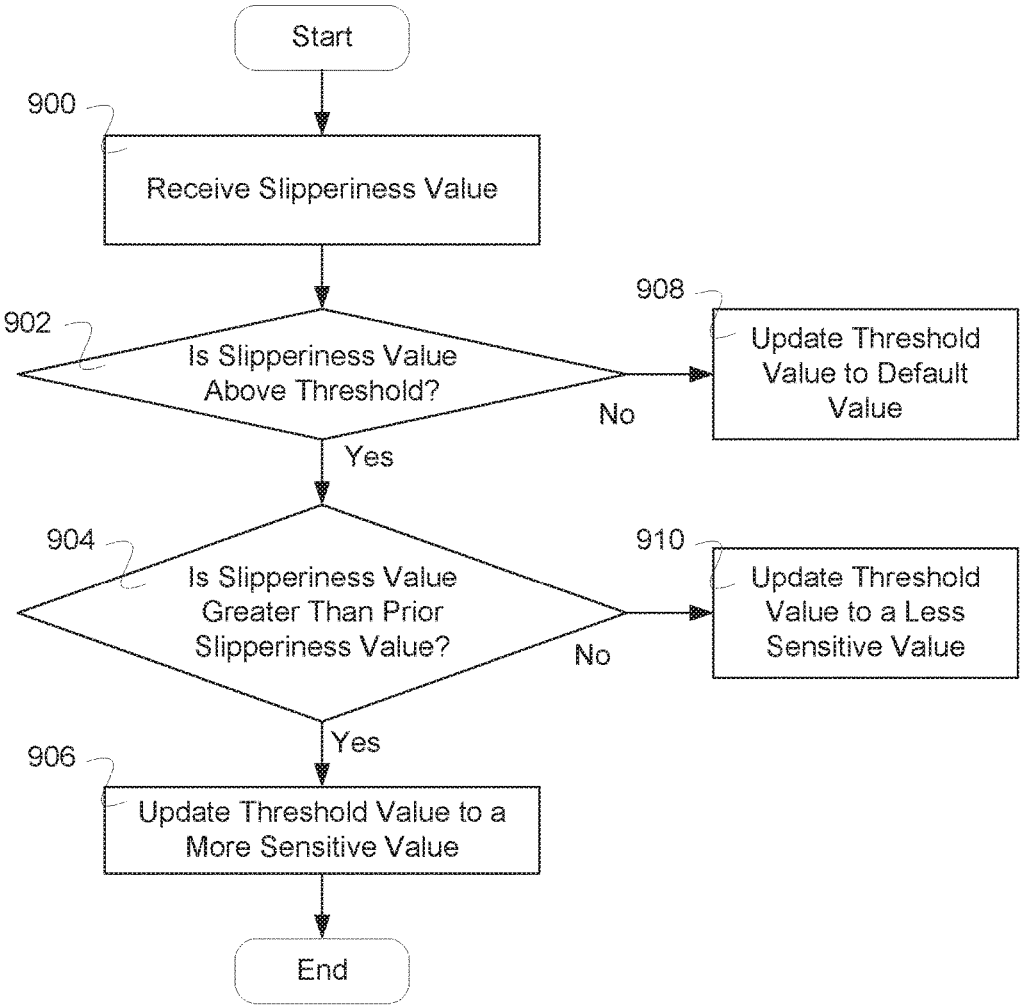
FIG. 9 is a flow diagram illustrating an embodiment of a process for updating threshold values.

FIG. 9 is a flow diagram illustrating an embodiment of a process for updating threshold values. In some embodiments, the process of FIG. 9 is used to implement 606 of FIG. 6. In the example shown, in 900 a slipperiness value is received. In 902, it is determined whether the slipperiness value is above a threshold. In the event that the slipperiness value is not above the threshold value, in 908 the threshold value is updated to a default value, and the process ends. In the event that the slipperiness value is above the threshold value, control passes to 904. In 904, it is determined whether the slipperiness value is greater than the prior slipperiness value. In the event that the slipperiness value is not greater than the prior slipperiness value, in 910 the threshold value is updated to a less sensitive value, and the process ends. For example, the threshold value is lowered if the lowering makes the threshold less sensitive or the threshold value is raised if the raising makes the threshold less sensitive. In the event that the slipperiness value is greater than the prior slipperiness value, in 906 the threshold value is updated to a more sensitive value, and the process ends. For example, the threshold value is lowered if the lowering makes the threshold more sensitive or the threshold value is raised if the raising makes the threshold more sensitive.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A system for determining road conditions, comprising:
an input interface configured to:
receive sensor data from one or more sensors; and
a processor configured to:
determine vehicle maneuver data associated with a current vehicle stopping maneuver based at least in part on the sensor data;
retrieve historical vehicle maneuver data associated with one or more historical vehicle stopping maneuver data instances;
determine a road slipperiness value for the current vehicle stopping maneuver based at least in part on the vehicle maneuver data and the historical vehicle maneuver data, wherein the historical vehicle maneuver data comprises a road slipperiness value for each historical vehicle stopping maneuver data instance of the one or more historical vehicle stopping maneuver data instances; and
update an event detection threshold based at least in part on the road slipperiness value for the current vehicle stopping maneuver.

2. The system of claim 1, wherein the vehicle maneuver data comprises a parameterized model of the sensor data.

3. The system of claim 2, wherein determining the vehicle maneuver data comprises selecting the parameterized model from a set of one or more parameterized models.

4. The system of claim 2, wherein determining the vehicle maneuver data comprises determining one or more parameters of the parameterized model.

5. The system of claim 2, wherein a parameter of the parameterized model is associated with the road slipperiness value.

6. The system of claim 1, wherein the vehicle maneuver data comprises historical vehicle maneuver data.

7. The system of claim 1, wherein retrieving the historical vehicle maneuver data comprises selecting the one or more historical vehicle stopping maneuver data instances based at least in part on the vehicle maneuver data associated with the current vehicle stopping maneuver.

8. The system of claim 1, wherein a historical vehicle stopping maneuver data instance of the one or more historical vehicle stopping maneuver data instances is associated with the road slipperiness value for the current vehicle stopping maneuver.

9. The system of claim 1, wherein the one or more historical vehicle stopping maneuver data instances comprises two or more historical vehicle stopping maneuver data instances.

10. The system of claim 1, wherein the sensor data is received from one or more of the following: an accelerometer, a brake system, an anti-lock braking system, a traction control system, or a drive wheel speed controller.

11. The system of claim 1, wherein the sensor data comprises one or more of the following: an acceleration magnitude, a stopping time, a stopping distance, an anti-lock braking system activation pattern, a drive wheel speed differential, or a traction control system activation pattern.

12. The system of claim 1, wherein the processor is further to determine a road slipperiness category.

13. The system of claim 1, wherein the processor is further to cause storage of the road slipperiness value for the current vehicle stopping maneuver.

14. The system of claim 1, wherein the processor is further to determine vehicle maintenance information based at least in part on the road slipperiness value for the current stopping maneuver.

15. The system of claim 1, wherein the processor is further to determine a road slipperiness anomaly based at least in part on a set of road slipperiness values determined from the sensor data measured at different locations.

16. The system of claim 15, wherein the road slipperiness anomaly comprises one or more of following: a fluid spill on the road, a trash spill on the road, a pile of leaves on the road, or an animal on the road.

17. The system of claim 1, wherein the event detection threshold is one of a plurality of event detection thresholds.

18. A method for determining road conditions, comprising:
receiving sensor data from one or more sensors;
determining, using a processor, vehicle maneuver data associated with a current vehicle stopping maneuver based at least in part on the sensor data;
retrieving historical vehicle maneuver data associated with one or more historical vehicle stopping maneuver data instances;

determining a road slipperiness value for the current vehicle stopping maneuver based at least in part on the vehicle maneuver data and the historical vehicle maneuver data, wherein the historical vehicle maneuver data comprises a road slipperiness value for each historical vehicle stopping maneuver data instance of the one or more historical vehicle stopping maneuver data instances; and updating an event detection threshold based at least in part on the road slipperiness value for the current stopping maneuver.

19. A computer program product for determining road conditions, the computer program product being embodied in a non-transitory computer readable storage medium and comprising computer instructions for:

receiving sensor data from one or more sensors;

determining vehicle maneuver data associated with a current vehicle stopping maneuver based at least in part on the sensor data;

retrieving historical vehicle maneuver data associated with one or more historical vehicle stopping maneuver data instances;

determining a road slipperiness value for the current vehicle stopping maneuver based at least in part on the vehicle maneuver data and the historical vehicle maneuver data, wherein the historical vehicle maneuver data comprises a road slipperiness value for each historical vehicle stopping maneuver data instance of the one or more historical vehicle stopping maneuver data instances; and updating an event detection threshold based at least in part on the road slipperiness value for the current vehicle stopping maneuver.

* * * * *